US008555530B2

(12) United States Patent
Cronk, Jr. et al.

(10) Patent No.: US 8,555,530 B2
(45) Date of Patent: Oct. 15, 2013

(54) SYSTEM AND METHOD FOR PIPELINE PADDING

(76) Inventors: Thomas J. Cronk, Jr., Odessa, TX (US); Billy W. Cronk, Odessa, TX (US)

( * ) Notice: Subject to any disclaimer, the term of this patent is extended or adjusted under 35 U.S.C. 154(b) by 263 days.

(21) Appl. No.: 12/781,197

(22) Filed: May 17, 2010

(65) Prior Publication Data

US 2011/0277356 A1 Nov. 17, 2011

(51) Int. Cl.
*E02F 5/22* (2006.01)

(52) U.S. Cl.
USPC ..... 37/142.5; 37/95; 37/337; 171/15; 171/112; 171/123

(58) Field of Classification Search
USPC ..... 37/142.5, 93, 95, 305, 306, 337, 392; 171/14, 15, 92, 98, 101, 112, 123, 128, 171/138; 209/270, 12.1; 210/394
See application file for complete search history.

(56) References Cited

U.S. PATENT DOCUMENTS 148,442 A * 3/1874 Gidley ..... 209/270
1,287,648 A * 12/1918 Currie ..... 171/92
1,339,371 A * 5/1920 Watson ..... 172/32
2,284,035 A * 5/1942 Blair ..... 171/16
2,298,566 A * 10/1942 Johnson ..... 414/507
2,723,473 A * 11/1955 Ludowici ..... 37/463
2,744,739 A * 5/1956 Evans et al. ..... 171/129
2,857,691 A * 10/1958 Curran ..... 172/33
3,054,199 A * 9/1962 Penote et al. ..... 37/349
3,703,776 A * 11/1972 Feistel, Jr. ..... 37/306
4,014,390 A * 3/1977 Teixeira ..... 171/124
5,084,991 A 2/1992 Cronk, Jr.
5,490,928 A * 2/1996 Tanii ..... 210/380.3
5,938,373 A * 8/1999 Scudder ..... 405/179
6,055,749 A * 5/2000 Cronk, Jr. ..... 37/142.5
6,318,930 B1 * 11/2001 Scudder ..... 405/179
7,886,463 B2 * 2/2011 Greenberg et al. ..... 37/142.5

* cited by examiner

*Primary Examiner* — Jamie L McGowan
(74) *Attorney, Agent, or Firm* — Winston & Strawn LLP

(57) ABSTRACT

An apparatus for padding a pipeline lying in a ditch separates fine particles from coarse particles in the material excavated from the ditch and windrowed along the side of the ditch. The apparatus includes a frame having an open ended hollow separating drum having a plurality of scoop members adapted to lift and drop excavated material through a screen located beneath the scoop members. The scoop members are spaced above the screen a distance such that the efficiency of the separating drum is increased.

11 Claims, 6 Drawing Sheets

SYSTEM AND METHOD FOR PIPELINE PADDING

FIELD OF THE INVENTION

The present invention relates generally to earth and material handling equipment and, more particularly, to an improved method and apparatus for separating a windrow of excavated material alongside a ditch into fine particles of dirt ("fines") and coarse particles that include clods and large rocks, and depositing the fines into the ditch and the coarse material back onto the windrow of excavated material.

BACKGROUND OF THE INVENTION

Cross country pipelines are usually coated with a corrosion-resistant substance. To protect the coating from damage when the ditch is back filled with excavated material, which may contain large rocks, the pipeline is first covered with fine particles of dirt to serve as a protective padding around the pipeline.

U.S. Pat. No. 5,084,991, issued to Cronk Jr. on Feb. 4, 1992, discloses a system for pipeline padding and is hereby incorporated by reference in its entirety. The disclosed system provides for padding of a pipeline lying in a ditch by separating fine particles from coarse particles in material excavated from the ditch and windrowed along the side of the ditch. As the system moves along the excavated material, a separator drum rotates to lift the material and rotate it. As the material is rotated above the drum, it falls through a screen or between rods which separate the fine materials of the excavated material from the coarse materials.

There is, however, a disadvantage to this system. There are scoop members attached to the drum which are used to lift the excavated material as the drum rotates. The scoop members are attached in very close proximity to the surface of the screen or rods which filter the fines from coarse material during rotation. Due to the close proximity, as the rotating scoop members begin to lift the excavated material, the material is retained between the scoop members and screen surface or rods until the respective scoop member has been rotated upwardly by the drum to the upper portion of the path of rotation, thereby resulting in limited relative movement of the excavated material with respect to the rods or screen surface resulting in less excavated material being filtered during a rotation.

Accordingly, there is a need in the art for an improvement to the system of Cronk, Jr., thereby providing a more efficient and cost-effective pipe padding operation.

SUMMARY OF THE INVENTION

The present invention provides embodiments and related methodologies for a pipe padding apparatus. The apparatus comprises a box-like frame adapted to move along a row of excavated material along side a ditch in which a pipeline has been laid. The frame comprises an open-ended hollow drum having a plurality of scoop members and a screen used to lift the excavated material as the frame moves along the row. The material is lifted using a plurality of scoop members spaced around the drum. As the drum rotates, the scoop members drop the excavated material wherein, due to gravity, the material falls through the screen, wherein the desired material is filtered. Due to the distance between the screen and scoop members, the efficiency of the filtering technique is increased. The filtered material then falls onto a conveyor where it is transported to ditch and laid atop the pipeline.

BRIEF DESCRIPTION OF THE DRAWINGS

Other advantages and features of the invention will become more apparent with reference to the following detailed description of the exemplary embodiments thereof in connection with the accompanying drawings, wherein like reference numerals have been applied to like elements.

DESCRIPTION OF ILLUSTRATIVE EMBODIMENTS

Illustrative embodiments and methodologies of the invention are described below as they might be employed in a pipeline padder or method of use thereof. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure. Further aspects and advantages of the various embodiments and methodologies of the invention will become apparent from consideration of the following description and drawings.

Figure 1:
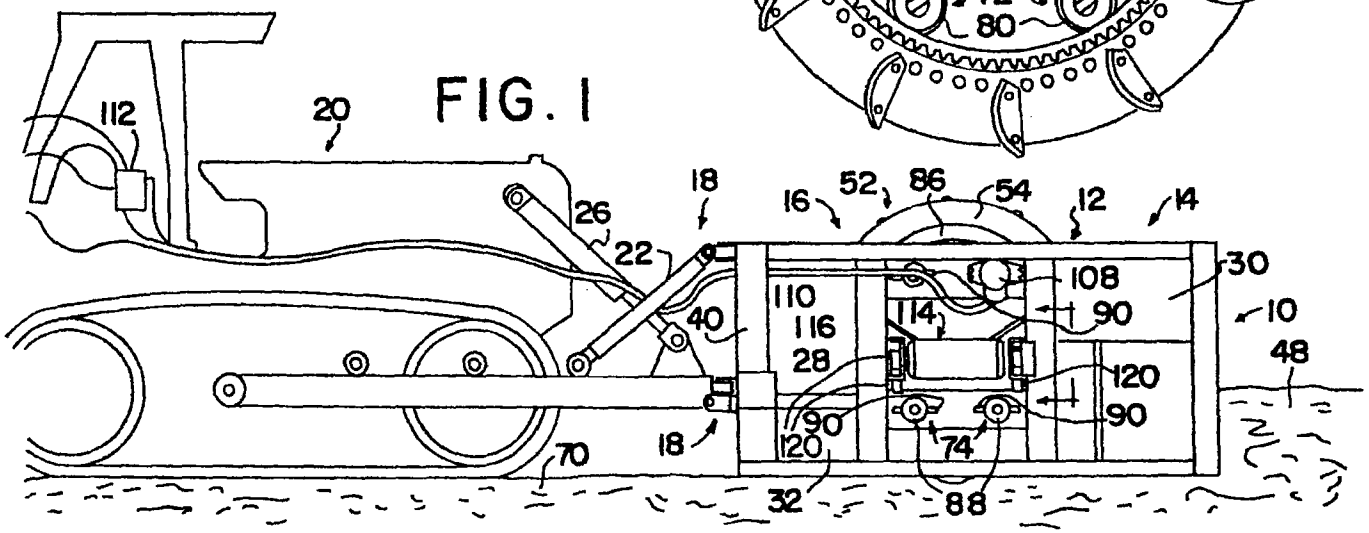
FIG. 1 is a simplified side elevational view of pipe padding apparatus constructed in accordance with an exemplary embodiment of the present invention.
Figures 2, 8:
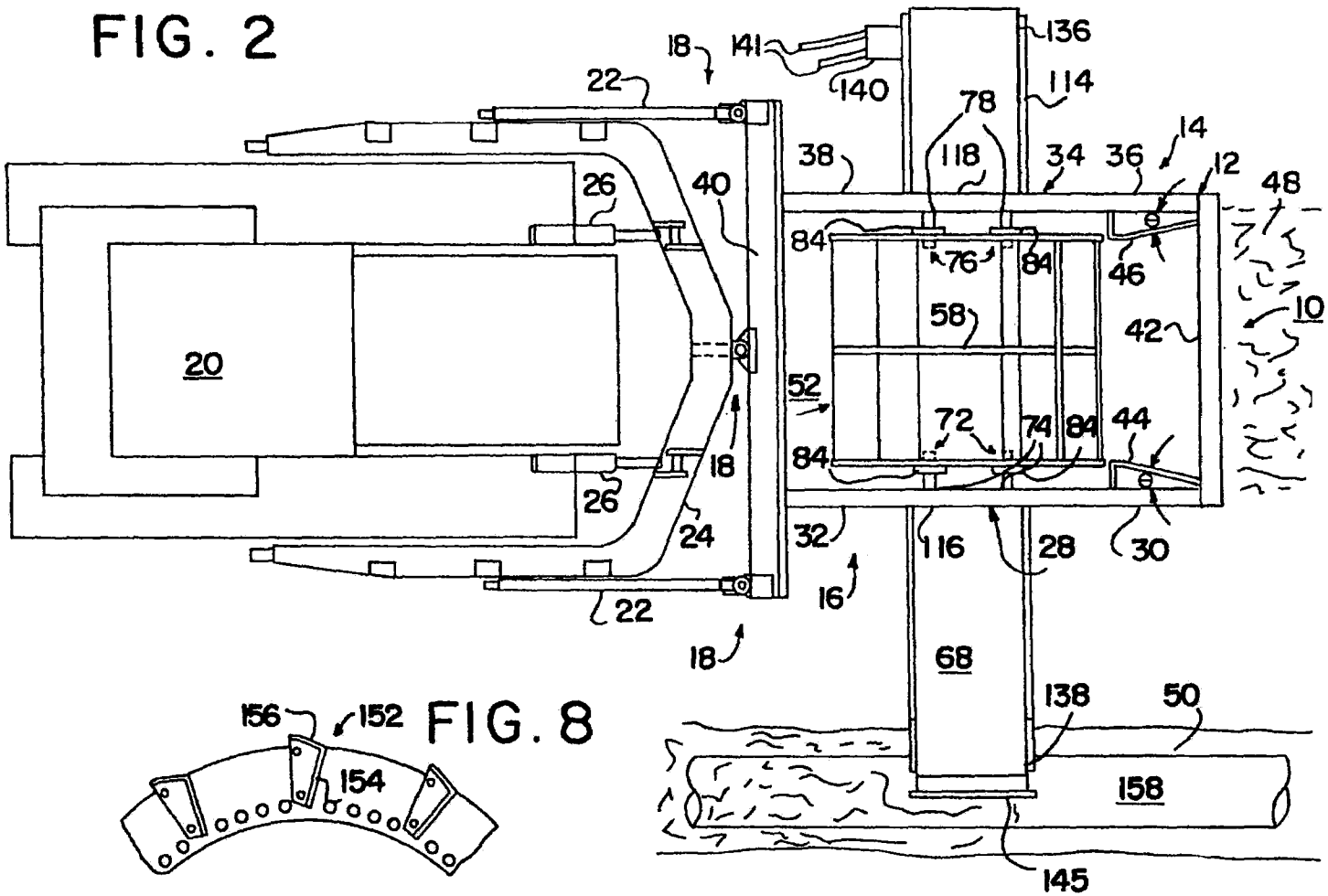
FIG. 2 is a simplified top plan view of an apparatus according to an exemplary embodiment of the present invention.
FIG. 8 is an elevational view of an alternate embodiment of the apparatus according to an exemplary embodiment of the present invention.

Referring to the exemplary embodiment of FIGS. 1 and 2 in particular, the pipe padding apparatus 10 comprises a generally box-shaped frame 12 having front portion 14 and rear portion 16. The rear portion 16 includes mounting means 18 to align with and attach to a tractor or bulldozer 20 at the same three attachment points as used to attach a blade (not shown) to a tractor or bulldozer 20. Mounting means 18 include adjustable mounting bars 22 attached between the generally box-shaped frame 12 and the forwardly extending yoke 24 of bulldozer 20. Tractor 20 is equipped with conventional yoke 24 that is elevated and lowered by piston and cylinder assemblies 26 through the conventional hydraulic system of tractor or prime mover 20.

The generally box-shaped frame 12 comprises a first side frame member 28 in the general form of a rectangular panel having a front end portion 30 and a rear end portion 32, and a second side frame member 34 in the general form of a rectangular panel generally parallel to the first side frame member and having a front end portion 36 and a rear end portion 38. A rear end frame member 40, in the general form of a rectangular panel generally perpendicular to and attached between first side frame member 28 and second side frame member 34 at rear end portions 32 and 38 and extending outwardly past the first and second side frame members 28 and 34, in an exemplary embodiment, is attached to mounting means 18. A front end frame member 42 is attached between first side frame member 28 and second side frame member 34 at front end portions 30 and 36. Its front end is open to receive the excavated material as it is moved thereover.

First guide means 44 projects inwardly from first side frame member 28 and second guide means 46 projects inwardly from second side frame member 34 to guide a portion of the excavated material 48 inwardly toward hollow drum 52, which is rotatably mounted in the generally box-shaped frame 12. In an exemplary embodiment, first guide means 44 and second guide means 46 comprise generally rectangular-shaped panels attached to the front end portions 30 and 36 that extend rearwardly at an angle away from the first and second side frame members 28 and 34 and toward the outer sides of hollow separating drum 52.

Figure 4:
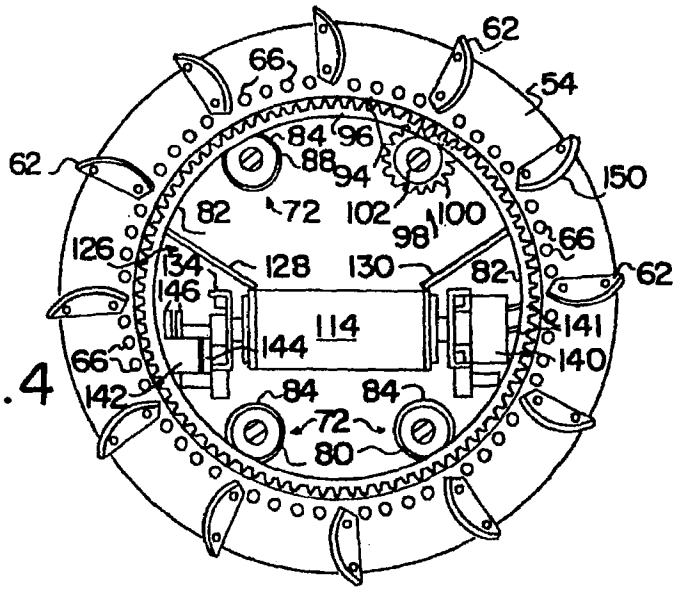
FIG. 4 is a cross-sectional view of the separating drum taken along lines 4-4 of FIG. 3 and showing the conveyor located in working relationship with the drum according to an exemplary embodiment of the present invention.
Figure 3:
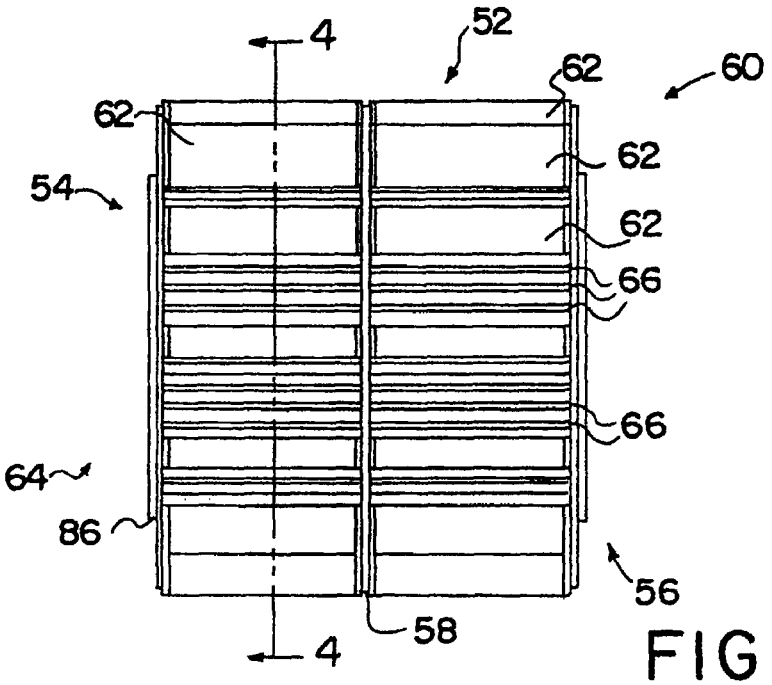
FIG. 3 is a front elevational view of the separating drum of an apparatus according to an exemplary embodiment of the present invention.

With reference to the exemplary embodiments of FIGS. 3 and 4, separating drum 52 comprises first outside ring member 54, second outside ring member 56, and center ring member 58. As can be appreciated, separating drum 52 may be constructed without the center ring member 58, depending upon the width of drum 52 and material chosen for its construction. Earth elevating means 60 are circumferentially spaced about the periphery of the hollow drum 52 and are attached between the outside ring members 54 and 56. In the exemplary embodiment, the earth elevating means 60 comprises spaced apart, arcuate scoop members 62 for lifting excavated material 48 as the rotating drum 52 is pushed forward through at least a portion of the windrow of material.

A plurality of elongated parallel rods 66 are spaced around and attached near the circumferences of center ring member 58 (if present) and outside ring members 54 and 56. In the disclosed embodiment, four elongated rods 66 are shown between adjacent arcuate scoop members 62, but it will be appreciated that the size and numbers of rods 66 as well as the spacing therebetween can vary. The rods perform a separating function by allowing fines 68 to fall into the drum 52 between adjacent rods 66 while keeping the residue of coarse or larger particles on the outer periphery of the drum 52 so that the residue will fall off the back side thereof upon further rotation. In one embodiment of the apparatus the rods were spaced 1½" apart. If smaller size fines are desired, this spacing could be decreased or sections of curved mesh or screen (not shown) may be attached to rods 66 between ring members 54, 56.

With reference to the exemplary embodiments of FIGS. 1, 2, 4 and 5*a*-5*b*, first rollers 72 are attached to first side frame member 28 by first mounting means 74, and second rollers 76 are attached to second side frame member by second mounting means 78. Each of the rollers 72 includes an annular periphery surface 80 that contacts and supports the inner periphery 82 of first outside ring member 54, and a rectangular raised portion or shoulder 84 extending radially outwardly from said annular periphery surface 80 to bear against side surface 86 of first outside ring member 54 to maintain first outside ring member 54 a predetermined distance from first side frame member 28. Each of the rollers 76 are the same or similar to the rollers 72 and support the inner periphery of second outside ring member 56 in a similar manner. Hollow drum 52 is thereby held in position for rotation between the first and second side frame members.

First mounting means 74 includes fastening means 88 and slotted apertures 90 formed in first side frame member 28. In the exemplary embodiment, fastening means 88 comprises a bolt and nut with the bolt positioned through elongated aperture 90 and aperture 92 of the roller 72. Elongated apertures 90 allow the rollers 72 and 76 to be moved with respect to the drum 52 and thus allow adjustment for any wear that occurs. Second mounting means 78 is the same as first mounting means 74 and support the second rollers 76.

At least one of the first and second outside ring members 54 and 56 include a drive ring or gearwheel 94 with drive teeth 96 formed on the inner periphery thereof. At least one of the rollers is structured to not only rotatably support drum 52, but also has drive teeth 100 to mate with teeth 96 and thus rotate the drum. Drive member 98 is keyed to shaft 102 which is driven by power means 104. Surface 106 of drive member 98 bears against side surface 86 of first outside ring member 54. In the exemplary embodiment, power means 104 comprises a reversible hydraulic motor 108, which is provided with hoses 110 and control box 112 for the operation and control thereof from within the tractor 20.

In an exemplary embodiment, both the first outside ring member 54 and the second outside ring member 56 include a drive ring 94 with drive teeth 96 which mesh with a drive member 98. Shaft 102 is connected to and drives both drive members 98. Reversible hydraulic motor 108 may be mounted to either first side frame member 28 or second side frame member 34 and may be connected to either end of shaft 102.

A transfer or transverse conveyor 114 extends through the hollow drum as well as through aperture or cutout 116 formed in first side frame member 28 and a similar aperture or cutout 118 in second side frame member 34. Transfer or transverse conveyor 114 is operatively mounted to first and second side frame members 28 and 34 by mounting means 120. In operation, fines 68 fall between rods 66 onto the moving conveyor belt 114. The fines are guided onto the conveyor by funnel means 126 comprising front guide plate 130 and rear guide plate 128, which extend between first and second outside ring members 54 and 56 and are attached to frame 134 of transfer conveyor 114. The conveyor 124 is supported along its length by rollers (not shown) mounted in frame 134. End rollers 136 and 138 serve as longitudinal limits for the conveyor belt 114.

Figure 7:
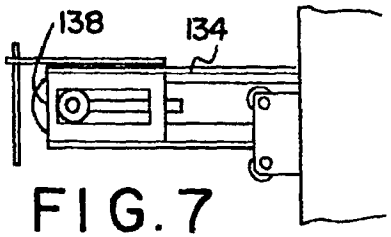
FIG. 7 is a side elevational view of a portion of the conveyor according to an exemplary embodiment of the present invention.

In this exemplary embodiment, end roller 136 is rotated by reversible hydraulic motor 140 to move conveyor belt 114 in either direction such that the fines 68 may be discharged from either side of the generally box-shaped frame 12. Reversible hydraulic motor 140 is connected to control box 112 by lines 141. Stop member 145 (see FIGS. 2 and 7) is attached to the end of frame 124 and provides a back stop for fines 68 as they leave conveyor belt 114 so the fines will fall directly down onto pipeline 158.

Transfer or transverse conveyor 114 is moved laterally of the drum 52 by reversible hydraulic motor 142 and rack and pinion mechanism 144 connected between frame 134 and reversible hydraulic motor 140. Lines 146 connect reversible hydraulic motor to control box 112.

A solid shield 148 is disposed internally of hollow drum 52 and provides a peripheral wall extending throughout a predetermined arc about the axis of rotation of drum 52 to maintain the excavated material 48 at the front portion 14 of generally box-shaped frame 12 so the excavated material 48 may be lifted up by scoops 62. Shield 148 extends between first outside ring member 54 and second outside ring member 56 and connects with the upper edge of front guide plate 130 and extends downwardly for at least forty-five degrees (45°) from its upper edge. Shield 148 may be attached to either first and second side frame members 28 and 34 or to frame 134 of transfer or transverse conveyor 114.

An exemplary embodiment of the arcuate scoop members 62 comprises a curved scoop portion 150 formed on a radius of about six inches and extending over an arc of about one hundred and fifteen degrees (115°. An alternate embodiment shown in FIG. 8 comprises a scoop portion 152 comprising first flat portion 154 and second flat portion 156 positioned at about ninety (degrees (90°) to the first flat portion 154.

Figure 9:
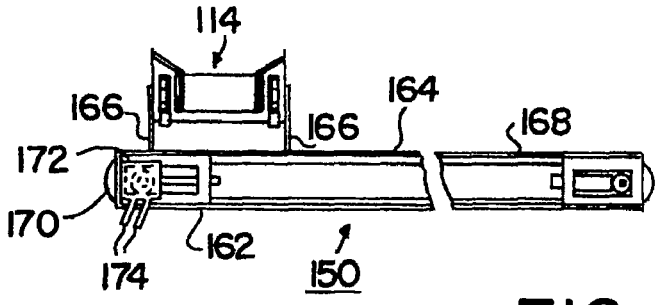
FIG. 9 is a side elevational view of a forward transfer conveyor at the end of the conveyor within the drum according to an exemplary embodiment of the present invention.
Figures 5A, 5B:
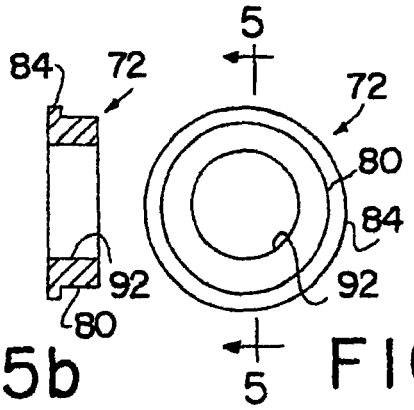
FIG. 5*a* is an elevational view of supporting apparatus for the drum according to an exemplary embodiment of the present invention.
FIG. 5*b* is a cross-sectional view taken along line 5-5 of FIG. 5*a* according to an exemplary embodiment of the present invention.
Figures 6A, 6B:
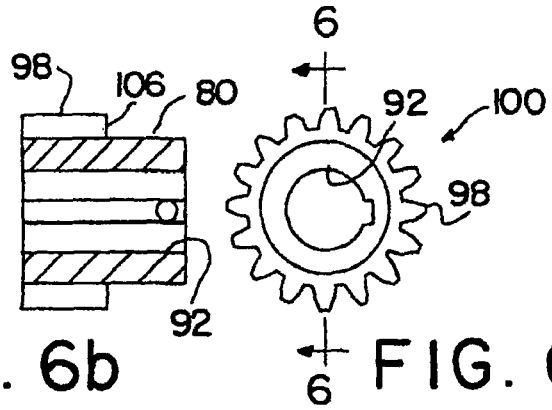
FIG. 6*a* is an elevational view of drive apparatus for the head according to an exemplary embodiment of the present invention.
FIG. 6*b* is a cross-sectional view taken along line 6-6 of FIG. 6*a* according to an exemplary embodiment of the present invention.

An additional embodiment of the present invention (see FIG. 9) includes a forward transfer conveyor 160 that is positioned generally parallel to the first and second side frame members 18 and 34 with a first or entrance end 162 under the discharge end of transfer or transverse conveyor 114 to receive the fines 68 therefrom, and transfer them forwardly and into ditch 50 onto the pipe or pipeline 158 at a position forward of the generally box-shaped frame 12. The frame 164 of the forward transfer conveyor 160 is attached to frame 134 of transfer or transverse conveyor 114 by attachments 166 to move toward and away from the ditch 50 with the transfer or transverse conveyor 114. The belt 168 is approximately eighteen inches in width.

End roller 170 is powered by hydraulic motor 172 and is connected to control box 112 by lines 174. The forward transfer conveyor 160 is especially useful when the excavated material 48 contains a great number of rocks or large chunks of hard earth that might be dislodged by the front portion 14 of the generally box-shaped frame 12 and could then fall into ditch 50 and damage the protective coating on the pipeline 158. The forward transfer conveyor 160 discharges the fines 68 onto the pipe or pipeline 158 ahead of the generally box-shaped frame 12 so that if rocks are dislodged they will fall on the fines 68 covering the pipeline 158 and not fall directly onto the pipeline 158.

In this exemplary embodiment, the frame 12 is approximately ten (10') feet long, five feet (5') high and seven feet (7') wide with the rear end frame member 40 being approximately twelve feet (12') wide. The hollow drum 52 is approximately six feet (6') in diameter. The transfer or transverse conveyor 114 is approximately sixteen feet (16') in length and has a belt which is about twenty-four inches (24") in width. It will be appreciated by one ordinarily skilled in the art having the benefit of this disclosure that these dimensions are only exemplary and do not limit the spirit and scope of the invention as disclosed.

In operation, the bulldozer or tractor 20 and the attached pipe padding apparatus 10 are aligned such that the row of excavated material 48 along the side of the ditch 50 is generally centered between the first and second side frame members 28 and 34. The frame 12 is positioned vertically by the tractor 20 with respect to the row of excavated material 48 so that a desired portion of excavated material 48 is lifted by the earth elevating means 60. The counterclockwise rotation (as viewed in FIG. 1) of the drum 52 is initiated by activating hydraulic motor 108. The transverse conveyor 114 is started by activating hydraulic motor 140. The end of the transverse conveyor 114 is positioned over the pipe or pipeline 158 in ditch 50.

The bulldozer 20 is moved forward at the desired speed while the first and second guide means 44 and 46 guide the excavated material 48 into the open front end of the frame and toward hollow drum 52 while shield 148 maintains the excavated material 48 at the forward portion of the drum 52 so the scoops 62 can lift the excavated material 48 upwardly. As the material is carried upwardly, the fines will fall between the rods into the drum and onto the laterally extending conveyor to be carried to the ditch and dumped on the pipe in the ditch. The coarse material will continue to be rotated by the drum 52 until it is dumped behind the drum. The rear frame member serves to prevent coarse material from being flung against the front of the tractor; but is sufficiently open at its lower end to permit the residue to fall onto the excavated material 48 that was not lifted upwardly.

In this exemplary embodiment, the amount of fines 68 that are deposited on the pipe or pipeline 158 in ditch 50 may be varied by one or more of the following: 1) varying the forward speed of the bulldozer 20 along the ditch 50, 2) varying the speed of rotation of the hollow drum 52, 3) varying the height of the generally box-shaped frame 12 with respect to the row of excavated material, and/or 4) varying the speed of the transfer conveyor.

Figure 10:
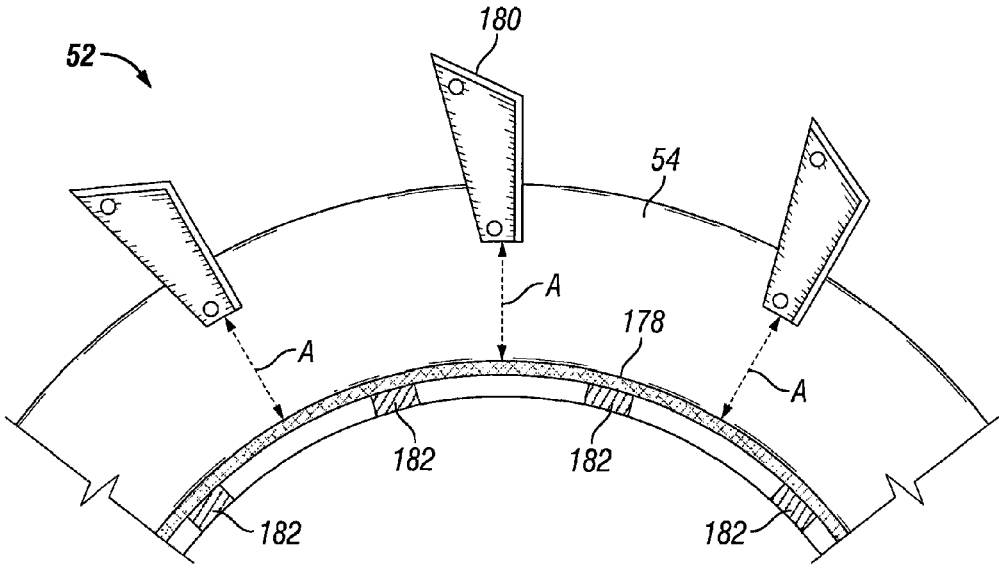
FIG. 10. is a cross-sectional view of a hollow drum according to an exemplary embodiment of the present invention.
Figure 11:
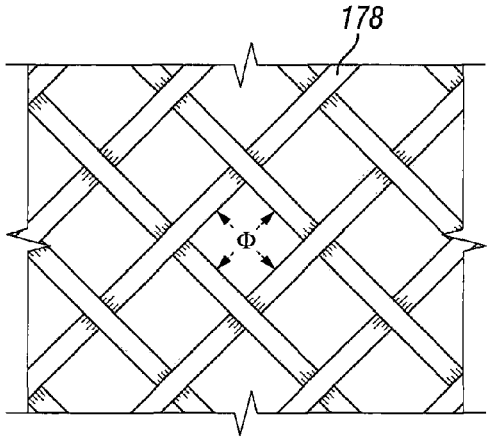
FIG. 11 illustrates an exploded view of a screen according to an exemplary embodiment of the present invention.

Referring to FIG. 10, a hollow drum 52 is illustrated according to an exemplary embodiment of the present invention. In this embodiment, scoop members 180 are connected between outside ring members 54, 56 spaced around separating drum 52 as previously described. Scoop members 180 may be curved, square, or any other form as would be appreciated by one ordinarily skilled in the art having the benefit of this disclosure. However, in this embodiment, scoop members 180 are spaced radially a distance A (FIG. 10) above a screen 178 supported by bars 182. Therefore, there is a predefined distance A between the inner or bottom edge of scoop members 180 and screen 178. In one embodiment, distance A is in the range of 2 to 8 inches and preferably approximately 6 inches. Screen 178 is supported by bars 182 spaced apart beneath screen 178. FIG. 11 illustrates an exemplary embodiment of screen 178, wherein the screen openings are sized according to the desired size of fines, such as in a range Φ of ¼ to 2 inches square and preferably ¼ to ½ inches square.

Figure 12A:
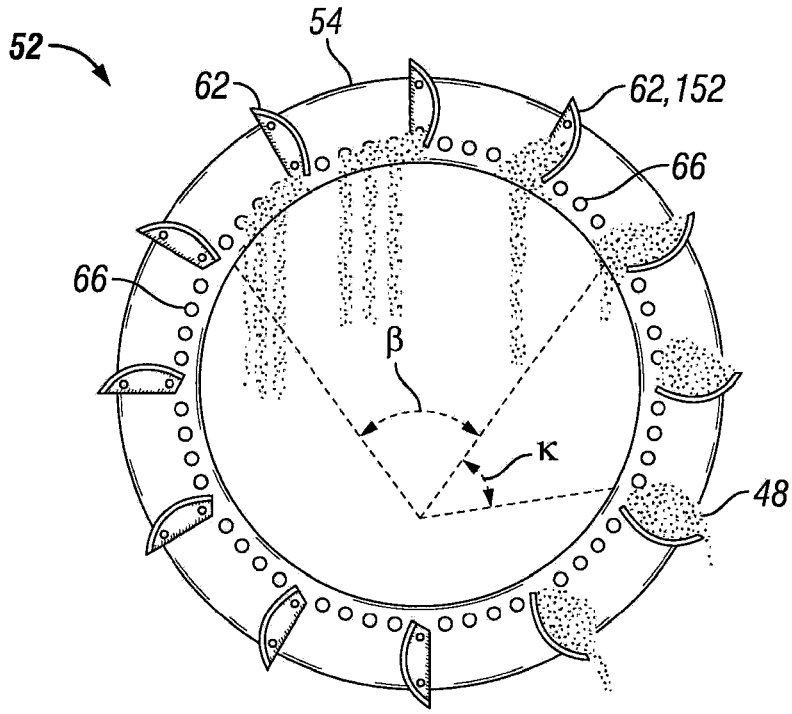
FIG. 12A (Prior Art)
FIG. 12A illustrates the excavation efficiency of a drum according to the prior art.
Figure 12B:
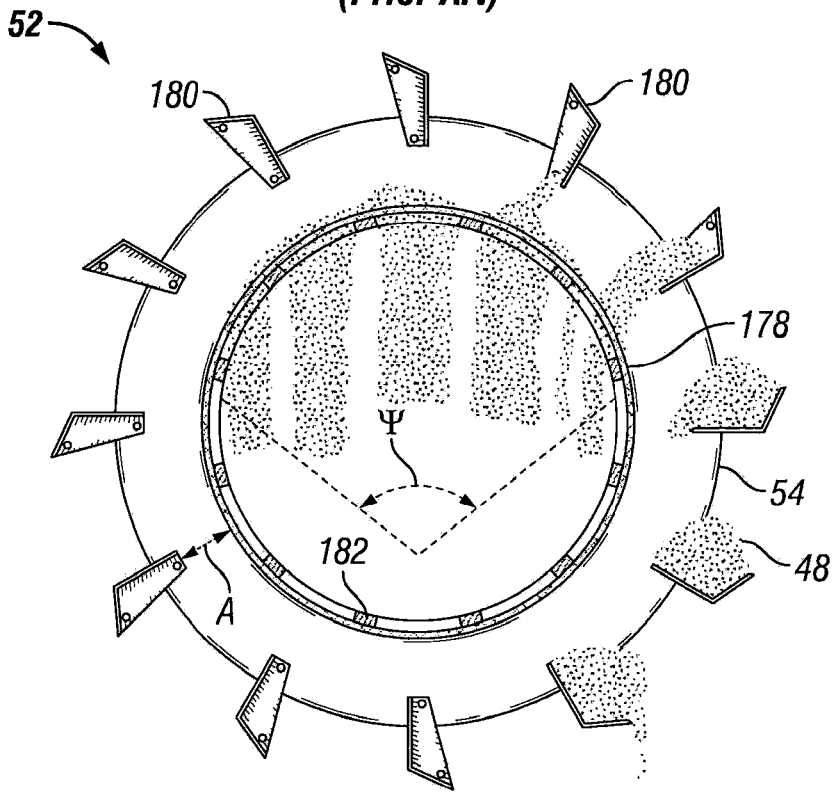
FIG. 12B illustrates the excavation efficiency of the exemplary embodiment of FIGS. 10 & 11.

By spacing scoop members 180 radially outwardly from screen 178 by distance A, the efficiency of the separating drum 52 is increased. It is believed that this increase to be as high as 300% above the rate of fine production provided under the same conditions by the previously disclosed embodiments. FIGS. 12A and 12B are exemplary figures meant to illustrate the mechanism by which it is believed that this increased efficiency is obtained. In FIG. 12A, the excavation efficiency of a prior art drum is illustrated. During operation, as drum 52 rotates and scoop members 62 pick up the material 48, very few of the fines within material 48 begin to fall between rods 66 until material 48 is lifted up to a certain level, for example, within screening arc β. Because the lower or bottom edge of scoop members 62 is located in close proximity with rods 66, a large portion of the material 48 simply sits in the scoop member 62,152 and rod 66 while it is lifted along non-screening arc K. It is believed that this lack of relative movement between material 48 and scoop member 62 and rods 66 during this period of rotation results in only small amounts, if any, of fines falling between the rods 66 while the material is rotated through non-screening arc K.

Referring to FIG. 12B, the excavation efficiency of an exemplary embodiment of the present invention is illustrated showing the advantage over the prior art. As scoop members 180 lift material 48 up, fines within material 48 begin falling across and through screens 178 much earlier (as compared to prior art FIG. 12A) during a single rotation of drum 52 due to opening created by distance A between scoop members 180 and screen 178. As such, the expanded screening arc ψ is provided, at least decreasing non-screening radius K. Therefore, the production efficiency is improved by up to 300% over the production capability of the embodiment of FIG. 12A. As can be understood by a skilled person increased efficiency as well as the magnitude of expanded screen arc ψ will depend upon the size opening in screen 178, length of distance A, the amount of suitable fines in the excavated material as well as other factors.

From the foregoing detailed description, it can be appreciated that a pipe padding apparatus constructed in accordance with this invention provides an improved pipe padding machine which is less complicated than the prior art and is less expensive. It is more easily transported from job-to-job. The prime mover may be used for other functions when the pipe padding apparatus is not being used. In addition, the production efficiency is greatly improved over prior art padders.

Exemplary embodiments of the present invention provide a pipe padding apparatus comprising: a box-like frame adapted to be moved along a row of material along a side of a ditch in which a pipeline has been laid, the box-like frame comprising: side walls with openings therein; and an open front adapted to receive at least a portion of the material as the box-like frame moves along; an open ended, hollow drum comprising: a plurality of scoop members adapted to lift the material received through the open front as the drum is rotated; a screen for screening coarse particles from fines within the material as the material is dropped from the scoop members onto the screen, wherein there is a predetermined distance between the scoop members and the screen; a mechanism adapted to support the drum between the side walls of the box-like frame, thereby allowing the drum to rotate about an axis transverse to the row of material; and a conveyor mechanism mounted to the box-like frame and extending in a direction generally parallel to the axis of rotation of the drum, the conveyor mechanism extending through the open ends of the drum, thereby receiving the fines as the fines drop through the screen and conveying the fines into the ditch.

In another embodiment, the predetermined distance between the scoop members and the screen is in a range of 2 to 8 inches. In yet another embodiment, a plurality of bars is located beneath the screen. In another exemplary embodiment, the screen has openings therein, the openings being in a range of ¼ to 2 inches square.

Another exemplary embodiment of the present invention provides an apparatus connected to a vehicle such as a tractor, for separating padding material from material excavated from the earth, the apparatus comprising: a frame attached to the vehicle and adapted to be moved through at least a portion of the excavated material; a separating drum rotatably mounted to the frame, the drum including: first outside ring member and second outside ring member; a circular screen having an outer surface and being attached between the first outside ring member and the second outside ring member; a plurality of scoop members attached between the first and second outside rings and spaced radially outwardly a predetermined distance from the outer surface of the circular screen, the scoops adapted to elevate at least a portion of the excavated material as the drum is rotated and moved longitudinally through the excavated material, the predetermined distance being sufficient to allow a portion of the excavated material to drop between the screen and the scoop member and move relative to the screen surface thereby separating a portion of the excavated material from the padding material as the scoop member is rotated through the screening arc while the apparatus is moved through the excavated material.

In another embodiment, the predetermined distance is in a range of 2 to 8 inches. In yet another embodiment, a plurality of bars is located beneath the screen. In yet another embodiment, the screen has openings therein, the openings being in a range of ¼ to 2 inches square.

An exemplary methodology of the present invention provides a method for separating padding material from material excavated from the earth, the method comprising the steps of: (a) providing a pipe padding apparatus adapted to be moved along a row of the material excavated from the earth located along a side of a ditch in which a pipeline has been laid, the apparatus comprising an open ended, rotatable drum comprising: a plurality of scoop members adapted to lift the material excavated from the earth as the drum is rotated; and a screen for screening coarse particles from fines within the material excavated from the earth as the material excavated from the earth is dropped from the scoop members onto the screen, wherein there is a predetermined distance between the scoop members and the screen; (b) scooping the material excavated from the earth into the scoop members; (c) rotating the scoop members; (d) screening the fines through the screen; and (e) transporting the fines atop the pipeline. In another methodology, step (d) further comprises the step of dropping the material excavated from the earth from the scoop members to the screen a distance in a range of 2 to 8 inches. In yet another methodology, step (a) further comprises the step of providing a plurality of bars below the screen. In yet another embodiment, step (a) further comprises the step of providing openings in the screens, the openings being in a range of ¼ to 2 inches square.

Although various embodiments have been shown and described, the invention is not limited to such embodiments and will be understood to include all modifications and variations as would be apparent to one skilled in the art. Therefore, it should be understood that the invention is not intended to be limited to the particular forms disclosed. Rather, the intention is to cover all modifications, equivalents and alternatives falling within the spirit and scope of the invention as defined by the appended claims.

What is claimed is:

1. A pipe padding apparatus comprising a box-like frame adapted to be moved through at least a portion of a row of material along a side of a ditch in which a pipeline has been laid, the box-like frame comprising:

(a) side walls with openings therein;

(b) an open front adapted to receive at least a portion of the material as the box-like frame moves along the side of the ditch;

(c) an open ended, hollow drum rotatably mounted between the side walls comprising:

a plurality of scoop members adapted to lift at least a portion of the material received through the open front as the frame is moved through the row of material and the drum is rotated;

a screen having an outer surface upon which the lifted material passes from the scoop members as the drum is rotated, the screen for screening course particles from fines within the lifted material wherein the scoop members are positioned radially outwardly from the screen outer surface a predetermined distance sufficient to allow at least a portion of the lifted material to pass between the scoop members and the screen outer surface whereby that portion of the lifted material moves relative to the screen outer surface as the drum is further rotated;

(d) a mechanism adapted to support the drum between the side walls of the box-like frame and to rotate the drum about an axis transverse to the row of material; and (e) a conveyor mechanism mounted within the drum and extending in a direction generally parallel to the axis of rotation of the drum, the conveyor mechanism extending through an open end of the drum, thereby receiving the fines as the fines pass through the screen and conveying the fines into the ditch about the pipeline.

2. A pipe padding apparatus as defined in claim 1, wherein the predetermined distance between the scoop members and the screen outer surface is in a range of 2 to 8 inches.

3. A pipe padding apparatus as defined in claim 1, wherein the screen has openings therein, the openings being in a range of ¼ to 2 inches square.

4. An apparatus to be connected to a vehicle such as a tractor, for separating padding material from material excavated from a ditch and depositing the padding material, as the vehicle moves through the excavated material, about a pipeline that has been laid in the ditch, the apparatus comprising:

a frame to be attached to the vehicle and adapted to be moved through at least a portion of the excavated material;

a separating drum rotatably mounted to the frame, the drum comprising:

first outside ring member and second outside ring member;

a circular screen having an outer surface and being attached between the first outside ring member and the second outside ring member;

a plurality of scoop members attached between the first and second outside rings and spaced radially outwardly a predetermined distance from the outer surface of the circular screen, the scoops adapted to elevate at least a portion of the excavated material as the drum is rotated and moved longitudinally through the excavated material, the predetermined distance being sufficient to allow a portion of the elevated material to pass between the circular screen outer surface and the scoop member whereby that portion of the elevated material moves relative to the screen outer surface as the drum rotates thereby increasing the length of the screening arc; and a conveyor mechanism mounted to the frame extending within the drum and in a direction generally parallel to the axis of rotation of the drum, the conveyor mechanism extending through an end of the drum, whereby the conveyor receives the fines as the fines pass through the screen and conveys the fines into the ditch about the pipeline.

5. An apparatus as defined in claim 4, wherein the predetermined distance is in a range of 2 to 8 inches.

6. An apparatus as defined in claim 4, wherein the screen has openings therein, the openings being in a range of ¼ to 2 inches square.

7. A method for separating padding material from material excavated from the earth and positioning the padding material around a portion of a pipeline, the method comprising the steps of:

(a) providing a pipe padding apparatus adapted to be moved through the material excavated from the earth and deposited along a side of a ditch in which a pipeline has been laid, the apparatus comprising an open ended, rotatable drum comprising:

a plurality of scoop members adapted to lift a portion of the material excavated from the earth as the drum is rotated while the padding apparatus is moved through the material; and a screen having an outer surface, the screen for screening coarse particles from fines within the material excavated from the earth, the lifted excavated material passing onto the outer surface of the screen from the scoop members as the screen and scoop members are further rotated, wherein the scoop members are positioned radially outwardly from the outer surface of the screen a predetermined distance so as to enable a portion of the lifted material to pass between the scoop member and the outer surface of the screen;

(b) scooping a portion of the material excavated from the earth into the scoop members as the padding apparatus moves through the excavated material while rotating the drum;

(c) continuing to rotate the drum so that each scoop member, in turn, is elevated sufficiently to cause the scooped material to pass onto the outer surface of the screen with a portion of the scooped material passing between the scoop member and the outer surface of the screen;

(d) screening the scooped material through the screen to separate the course particles from the fines;

(e) receiving the fines as the fines pass through the screen; and (f) conveying the fines from the drum and depositing the fines about a portion of the pipeline.

8. A method as defined in claim 7, wherein the predetermined distance of step (a) is a distance in a range of 2 to 8 inches.

9. A method as defined in claim 7, wherein step (a) further comprises the step of providing openings in the screen, the openings being in a range of ¼ to 2 inches square.

10. A pipe padding apparatus adapted to be moved through a row of excavated material containing coarse particles and fines located along a side of a ditch, the apparatus comprising:

a rotatable, open-ended hollow drum comprising;

a plurality of scoop members adapted to lift at least a portion of the material as the drum is rotated and moved through the row of material; and a screen having an outer surface, the screen for separating coarse particles from fines within the lifted material as the drum is rotated, the scoop members being positioned radially outwardly from the screen at a distance sufficient to allow at least a portion of the lifted material to pass between the scoop member and the screen outer surface, thus resulting in an expanded screening arc.

11. A pipe padding apparatus adapted to be moved through a windrow of excavated material containing coarse particles and fines located along a side of a ditch, the apparatus comprising:

a rotatable, open-ended hollow drum comprising;

first and second outside ring members;

a plurality of scoop members connected to first and second ring members, said scoop members adapted to lift at least a portion of the material as the drum is rotated and moved through the row of material; and a plurality of spaced, parallel rods connected to first and second ring members, each rod having an outer surface, the rods for separating course particles from fines within the lifted material as the drum is rotated, the lifted material passing onto the outer surfaces of the parallel rods as the drum continues to rotate, the scoop members being positioned radially outwardly from the outer surface of the rods at a distance sufficient to allow at least a portion of the lifted material to pass between the scoop member and the outer surface of the parallel rods as the drum continues to rotate.

* * * * *